United States Patent [19]

Boggs et al.

[11] 4,239,187

[45] Dec. 16, 1980

[54] WINDER STRING-UP METHOD AND APPARATUS

[75] Inventors: Beryl A. Boggs, Richmond, Va.; Mandayam C. Narasimhan, Seekonk, Mass.; Hsin L. Li, Parsippany, N.J.

[73] Assignee: Allied Chemical Corporation, Morris Township, Morris County, N.J.

[21] Appl. No.: 54,352

[22] Filed: Jul. 2, 1979

[51] Int. Cl.[3] ..... B65H 54/00; B65H 65/00; B65H 75/28

[52] U.S. Cl. ..... 242/25 R; 242/47

[58] Field of Search ..... 242/25 R, 25 A, 18 R, 242/18 A, 18 PW, 47, 78, 78.1, 78.3, 80, 81, 19, 48, 74, 125.1, 54 R, 67.1, 56 R

[56] References Cited

U.S. PATENT DOCUMENTS

| | | | |
|---|---|---|---|
| 3,980,244 | 9/1976 | Pietroni | 242/25 A |
| 3,994,058 | 11/1976 | Sasaki et al. | 242/25 R X |
| 4,019,543 | 4/1977 | Sasaki et al. | 242/25 R X |
| 4,026,483 | 5/1977 | Skalleberg | 242/25 R |
| 4,116,394 | 9/1978 | Smith et al. | 242/25 R |
| 4,181,267 | 1/1980 | Schmitz-Steger | 242/25 R |

*Primary Examiner*—Stanley N. Gilreath
*Attorney, Agent, or Firm*—Ernest D. Buff; Gerhard H. Fuchs

[57] ABSTRACT

Method and apparatus is provided for the inline string-up, in automatic fashion, of a rapidly advancing filament, particularly a glassy alloy strip, from a high speed continuous casting operation onto a rotating winding wheel. The leading segment of the advancing filament is passed into the nip of two counterrotating brush rollers 15 having a peripheral velocity exceeding that of the advancing filament to produce a sliding frictional tensioning of the filament. The brush rollers and engaged filament are then moved over the rotating winding wheel 28 to lay a segment of the advancing filament onto the rotating winding surface. A cut-and-grip device 8 associated with the winder is then actuated to cut the filament at the winding surface and to secure the filament onto the winder, whereupon winding of the advancing filament proceeds.

7 Claims, 8 Drawing Figures

WINDER STRING-UP METHOD AND APPARATUS

BACKGROUND OF THE INVENTION

The present invention relates generally to the string-up of the leading portion of a continuous filament inline from a continuous forming process to a take-up device and specifically to the winder string-up of the leading portion of a continuous metal filament, particularly a glassy alloy strip, moving at high speed as it departs a moving quench surface in a high speed continuous casting process.

Glassy alloys are of considerable technological interest owing to their extraordinary physical properties as compared to the properties characterizing the polycrystalline form of such alloys. An overview of the nature of such materials and their properties are given in "Metallic Glasses", 28:5 Physics Today (1975) by J. J. Gilman. Representative examples are shown in U.S. Pat. No. 3,856,513 "Novel Amorphous Metals . . . " issued Dec. 24, 1974, to H. Chen and D. Polk, hereby incorporated by reference. The term "glassy alloy" is intended to refer to metals and alloys that are rapidly quenched from a liquid state to a substantially amorphous solid state, typically having less than about 50% crystallinity, and is considered to be synonymous with such terms as "amorphous metal alloy" and "metallic glass". Glassy alloys are well documented in the literature. For an extensive background see "Metallic Glasses", American Society For Metals (1978).

In the production of glassy alloy continuous filaments, typically an appropriate molten alloy is quenched at extreme quench rates, usually at least about $10^{6}$° C./sec., by extruding the molten alloy from a pressurized reservoir through an extrusion nozzle onto a high speed rotating quench surface, as is representatively shown in U.S. Pat. No. 4,142,571 for "Continuous Casting Method for Metallic Strips" issued Mar. 6, 1978, to M. Narasimhan, hereby incorporated by reference. Such filaments are necessarily thin, typically about 25 to 100 microns, owing to the extreme heat transfer requirements to prevent substantial crystallization, though considerable selectivity may be exercised respecting the transverse dimensions and cross-section of the filament. Thus, the term "filament" is intended to include strips, narrow and wide, as well as wire-like filaments.

It is commercially desirable to wind the filament inline with its casting process, as representatively shown in U.S. Pat. No. 3,938,583 "Apparatus For Production of Continuous Metal Filaments" issued Feb. 17, 1976, to S. Kavesh, hereby incorporated by reference. However, initiation of winding inline with the casting process is especially difficult for at least two reasons. First, linear casting speeds are high, typically 1,000 to 2,000 meters per minute (37 to 75 miles per hour). To string-up the filament inline from the casting process to a winder, the leading portion of the high speed filament must be captured as it departs the rotating quench surface and translated to the winder. String-up must be accomplished quickly and precisely, otherwise an entangled mass of filament accumulates rapidly. Secondly, the tension exerted on the filament during string-up must be maintained within limits. Tension must be sufficient to substantially dampen disrupting oscillations of the filament (excessive "flutter") but not so much as to disrupt the quenching operation.

It is conventional in high speed filament string-up to use an aspirator, whereby the leading portion of the moving filament is drawn through an aspirating nozzle for subsequent translation of the filament to the winder. There are several shortcomings of this method. First, the process usually must be done manually. Second, the noise level produced by such aspiration often exceeds 100 dB in the immediate vicinity. Third, there is a practical limit on the width of filaments that may be aspirated, probably about 8 to 10 centimeters for metallic filaments. Fourth, oscillations are induced in the filament by the turbulent flow through the aspirator.

These shortcomings of the conventional approach in stringing up a continuously formed filament directly from a high speed continuous casting process to an inline winder are overcome by the present invention, which provides for such string-up in a manner that is rapid, automatic, precise, and relatively quiet and that further permits filament tension control during string-up without complex feedback control.

SUMMARY OF THE INVENTION

The invention provides for the automatic string-up of a rapidly advancing filament, particularly a glassy alloy strip, directly from a high speed continuous forming process onto an inline winder. Such string-up is accomplished by engaging the leading portion of the rapidly advancing filament in the nip of two counterrotating brush rollers and then moving the configuration over the winder to lay the filament onto the winding surface, the filament then being secured to the winder by an automatically actuated cut-and-grip mechanism, whereupon inline winding of the filament proceeds.

The method of the invention for the inline string-up of a rapidly advancing filament from a continuous forming operation onto a rotating winding wheel comprises the steps:

(a) passing the leading portion of the filament into the nip of two counterrotating brush rollers having a peripheral velocity exceeding the velocity of the filament to the extent sufficient to produce a sliding frictional tensioning of the advancing segment of the filament;

(b) moving the brush rollers along a predetermined path passing over the winding wheel to lay a segment of the filament onto the rotating winding surface; and (c) cutting the filament within its contact arc on the winding surface and securing the leading portion of the advancing segment of the filament onto the winding surface, whereupon winding of the advancing filament proceeds.

Preferably, step (a) further includes selecting the tension exerted on the advancing filament by the brush rollers according to the speed difference between the surface of the brush rollers and the advancing filament and according to the degree of filament-brush contact interaction.

The apparatus of the invention for the inline string-up of a rapidly advancing filament from a continuous forming operation onto a rotating winding wheel comprises the elements:

(a) two nipping brush rollers having selectable interference and speed of counterrotation, adapted for passing the filament into the nip thereof and tensioning the advancing segment of the filament in a sliding frictional manner;

(b) transfer means for moving the brush rollers along a predetermined path passing over the winding wheel to lay a segment of the filament onto the winding surface; and (c) grip means for cutting the filament at the winding surface and securing the advancing segment of the filament onto the winding surface.

BRIEF DESCRIPTION OF THE DRAWINGS

Further details are given below with reference to the embodiments shown in the drawings wherein.

DESCRIPTION OF THE PREFERRED EMBODIMENTS

Figure 1:
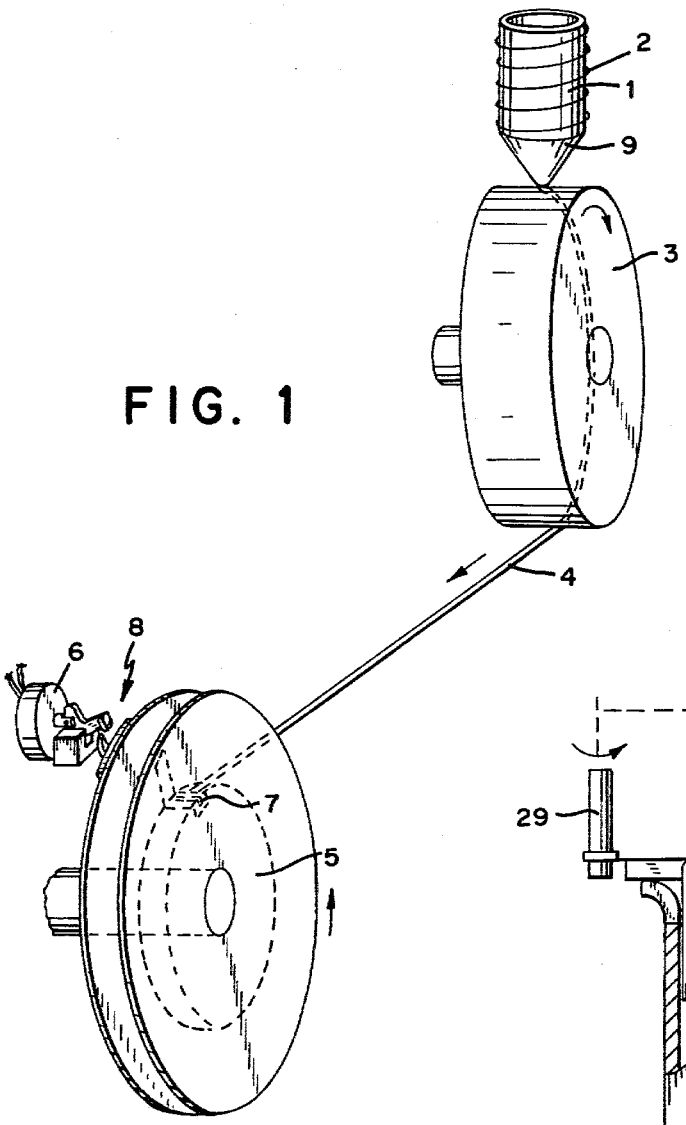
FIG. 1 shows typical prior art apparatus for the continuous casting and inline winding of glassy alloy filaments, wherein molten alloy is extruded through a nozzle onto a quench roll with the solidified filament being wound directly onto a winding wheel.

Referring specifically to the drawings, in FIG. 1, typical prior art apparatus for the continuous casting of a glassy alloy filament is illustrated to point out the general use of the present invention. Molten alloy is contained in a crucible 1 provided with a heating element 2. Pressurization of the crucible with an inert gas causes a molten stream to be extruded through a nozzle 9 at the base of the crucible onto a rotating quench wheel 3. The solidified, moving filament 4 after its breakaway point from the quench wheel is routed onto a winding wheel 5, which may be provided with a torque controller (not shown) to regulate the winding tension exerted on the filament.

To initiate winding in conventional fashion, the filament is strung-up by utilizing an aspirator (not shown), whereby the leading portion of the advancing filament is drawn through an aspirating nozzle. An operator then manipulates the aspirator to lay the advancing filament onto the core of the winding wheel, rotating at a speed approximately matching that of the advancing filament. A trigger device 6, such as a photoelectric sensor and solenoid, then releases a spring loaded, pivotal gripping element 7 associated with the winding wheel to cut and secure the advancing filament 4 to the wheel 5, whereupon winding proceeds inline with the casting process. Representative examples of such apparatus are shown in U.S. Pat. No. 4,116,394 "Moving Filament Gripping Mechanism" issued Sept. 26, 1978 to R. Smith et al., hereby incorporated by reference. Upon the winding wheel becoming filled, the advancing filament may be cut and transferred to an empty rotating winder by a conventional transfer device (not shown).

Winder string-up of a glassy alloy advancing filament in the above described conventional manner is especially difficult and tedious due to the high speed of the filament, typically up to 2200 meters per minute. Speeds of this magnitude are frequently a prerequisite to practical operation if the desired characteristics of the filament are to be retained. Glassy alloy filaments, as discussed above, are spun at high speed to achieve the extreme quench rate required to produce an amorphous alloy.

Figure 2:
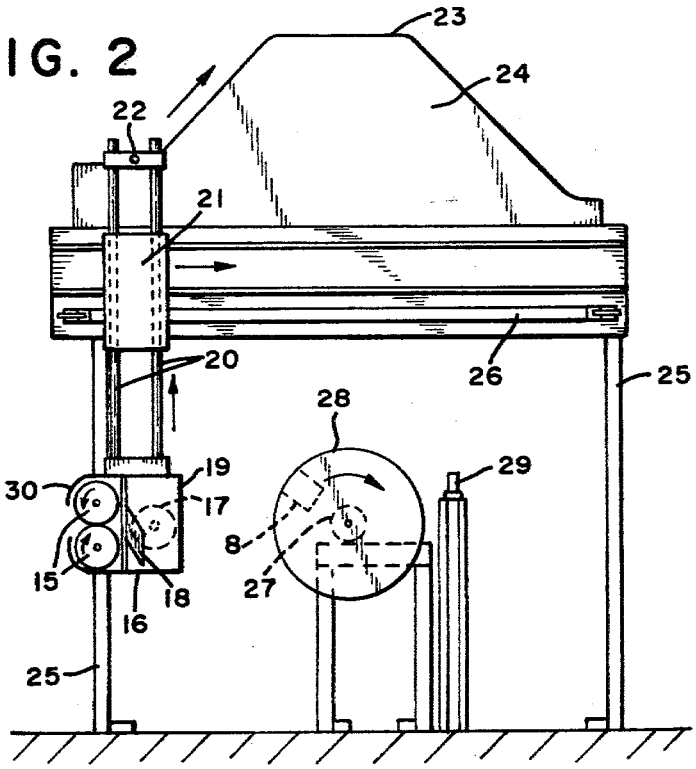
FIG. 2 shows an overall side view of the string-up device of the present invention, wherein two counterrotating brush rollers engage and tension the rapidly advancing filament as it first departs the casting operation and are then moved over the winding wheel to lay the filament onto the rotating winding surface whereupon the filament is automatically cut and secured to the winding surface.
Figure 3:
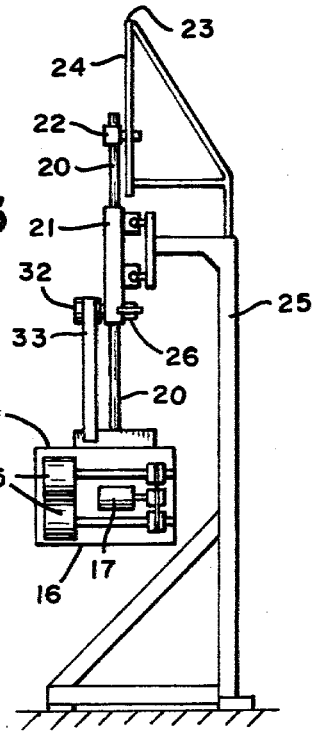
FIG. 3 shows an end view of the device with respect to FIG. 2.

In FIGS. 2 and 3, a side view and an end view, respectively, of an embodiment of the present invention are illustrated. The device provides a means for automatically stringing up the rapidly advancing filament from the high speed continuous casting process directly onto an inline winder. In essence, two counterrotating brush rollers in nipping contact engage and tension the rapidly advancing filament in their nip as it first departs the forming operation and are then moved over the winding wheel to lay the filament onto the rotating winding surface, whereupon the filament is secured to the winding wheel by an automatically actuated cut-and-grip device as described above.

The two brush rollers 15 counterrotating in nipping contact are mounted in a suitable frame 16 with an associated roller drive motor 17 and with a take-up basket to contain the advanced segment of the filament or preferably a simple deflector plate 18 that deflects the advanced segment to the side, as scrap for later recycle. The configuration is collectively termed a "take-up head" 19. The take-up head 19 is vertically supported by two tubular supporting members 20 which slidably pass vertically through channels within a traverse block 21. The supporting members at their upper extremities are secured to cam follower block 22 having a roller bearing for tracking along the cam contour 23 of a camplate 24. The camplate 24 is secured atop overall frame members 25. The traverse block 21 is driven horizontally across the structure by a conventional pneumatic cyclinder 26 or other conventional actuating device. Thus, as the traverse block is driven directly across the structure, the cam follower block 22 tracks the cam contour 23 causing the head supporting members 20 to slide vertically and freely through the traverse block 21, thereby moving the take-up head 19 with engaged filament over and below the winding wheel 28 to lay the advancing filament onto the rotating winding surface 27. A vertical actuating motor or pneumatic cylinder and the like may readily be used in lieu of the cam 24. At this point in the string-up sequence, a hold-down roller 29 is actuated, as for example by a photoelectric detector or microswitch whereby the roller 29 swings from a vertical orientation, allowing clearance of the filament coming into position, into a horizontal orientation and is then driven downward by a pneumatic cyclinder to depress the filament behind the winding wheel 28 and thereby to accentuate the contact arc of the filament on the winding surface 27. At this point, the cut-and-grip mechanism 8 is actuated to cut the advanced segment of the filament and to grip or secure the advancing filament onto the winding wheel, whereupon winding proceeds inline with the continuous casting operation. The take-up head 19 remains idle behind the winding wheel 28 until an interruption in the casting process necessitates another string-up operation.

The brush rollers serve the functions of capturing and tensioning the advancing filament. The brush rollers, preferably wire brushes as discussed below, are aligned with the filament casting process such that as the leading portion of the advancing filament first breaks away from the quench wheel as casting begins, the filament is directed into the nip of the brush rollers. Thus, the advancing filament is said to be "captured" for winder string-up. The advanced segment of the filament that passes through the roller nip during string-up, as opposed to the advancing segment moving into the nip, is conveniently deflected to the side. A V-guide may be mounted in front of the rollers to assure that the filament remains between the brush surfaces. A shroud 30 encases the brush rollers to reduce windage turbulence at the nip entrance, thereby tending to reduce filament flutter.

To tension the advancing filament, the brush rollers are driven at a speed such that their surface speed exceeds that of the advancing filament, thereby tensioning the filament in sliding frictional contact. As discussed, tension is normally required to prevent disrupting wave-like longitudinal oscillations from being established between the casting wheel and the take-up head. A key advantage of tensioning in a sliding frictional manner with brush rollers is that no complex feedback controller is required for precise speed control. Tension on the filament is controlled by two major aspects: filament-roller speed difference and the degree of filament-roller contact interaction in the nip.

Generally, filament tension increases as filament-brush speed difference increases. To illustrate, a filament about 1 inch wide (2.54 cm) by about 50 microns thickness moving at about 900 meters per minute is tensioned by wire brush rollers of 6 inches (15.2 cm) diameter driven at a surface speed of about 40% greater than the filament or about 2700 RPM. As a guideline, roller RPM should be minimized, to the extent acceptable regarding tensioning, to minimize flutter induced in the advancing filament by the rotation of the rollers.

The second major aspect in controlling filament tension is the degree of "contact interaction" between the rollers and the filament in the nip, i.e. the firmness of the grip on the filament in the nip. Generally, as contact interaction increases, the greater the filament tension that may be exerted by the rollers. The degree of contact interaction is limited by the susceptability of the filament to surface blemishing and is selectable by 3 factors principally. As the effect of each factor increases, contact interaction tends to increase. First, the diameter of the brush rollers determines the contact surface in the nip. Second, brush interference at the nip (overlap of brush bristles at the nip) is a strong factor. It is to be emphasized that brush interference is determined at speed. To illustrate, bristles of twisted steel wire will elongate considerably under centrifugal force. It is quite common that the brushes at rest will be spaced apart by some small amount, for example 0.1 to 0.2 cm, but will counterrotate in interferring contact at operating speed. Third, the nature of the brushes affords considerably design latitude considering bristle stiffness, coarseness, and number density.

Thus, the tension exerted on the advancing filament by the brush rollers is selectable according to the extent that roller peripheral speed exceeds filament speed and according to the degree of filament-brush contact interaction. Filament tension must be great enough to dampen disrupting flutter in the advancing filament, but not so great as to perturb the continuous casting operation. For example, one problem caused by too great a tension (roller speed) is instability of the breakaway point of the advancing filament from the quench wheel, thereby causing large, disruptive oscillations in the filament.

Figure 4A:
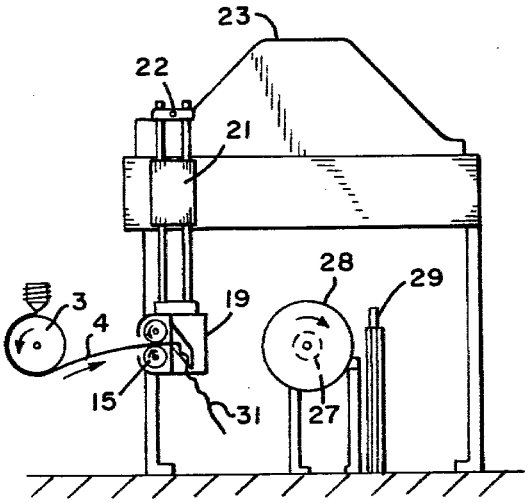
FIGS. 4 A, B, C, and D show schematically the motion sequence of the device in stringing up the rapidly advancing filament onto the winder.
Figure 4B:
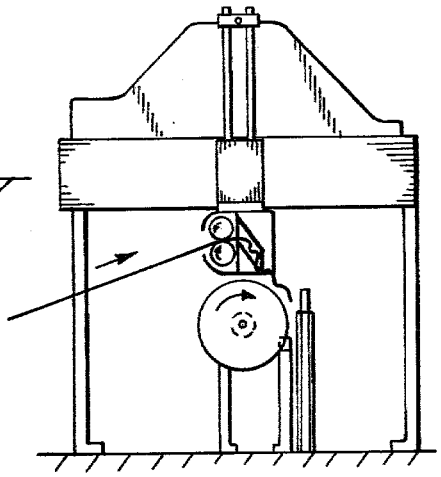
Figure 4C:
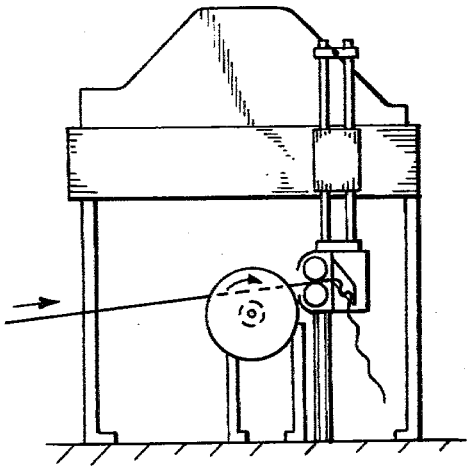
Figure 4D:
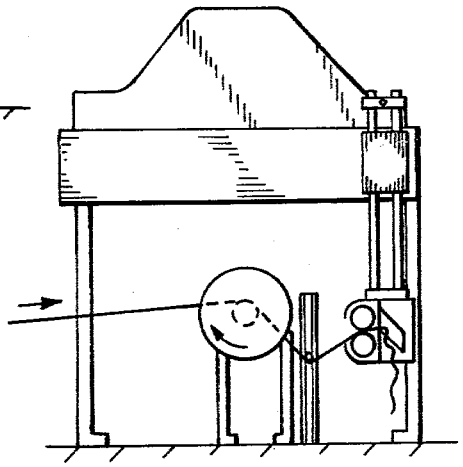

In FIGS. 4A, B, C, and D, the operating sequence of the device is shown schematically during string-up of a filament 4 from the casting wheel 3 to the inline winder 28. In FIG. 4A, the nip of the brush rollers 15 is aligned with the casting operation such that as casting begins, the leading edge of the advancing filament upon breaking away from the quench wheel passes into the nip of the brush rollers. At this point in the string-up sequence, the advancing filament is captured and tensioned in the take-up head 19, with the advanced segment 31 of the filament being neatly deflected to the side. Next, the transfer block 21 begins to move the take-up head 19 toward the winder 28. In FIG. 4B, the take-up head was moved over the winder as a consequence of the cam follower block 22 moving along the cam surface 23. In FIG. 4C, the take-up head has moved behind and below the winder to lay the advancing filament 4 onto the rotating winding surface 27. Rotational velocity is adjusted so that the peripheral velocity of the winding surface matches the velocity of the advancing filament, allowing for thermal contraction as the filament cools. At this point in the sequence, the hold-down roller 29 is actuated. In FIG. 4D, the hold-down roller 29 has depressed the filament behind the winder for the purpose of accentuating the contact angle of the filament on the winder to facilitate the cut-and-grip operation. At this point, the cut-and-grip device is actuated to cut the advanced segment of the filament and to secure the advancing filament to the winder, whereby inline winding proceeds. The take-up head remains idle in this final position until another string-up is needed.

It is preferred to include a counterbalancing mechanism for the take-up head 19 to promote the ease with which the cam follower block 22 tracks the cam surface 23, particularly the upwardly inclined portion of the cam surface. A suitable counterbalancing mechanism is shown in FIG. 3 which includes a spring loaded reel 32 tending to wind a metal strip 33 that is secured to the take-up head 19. The counterbalancing reel 32 has adjustable spring tension.

Figure 5:
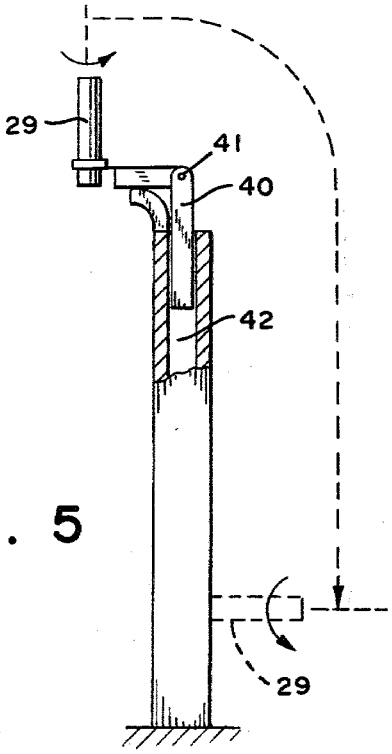
FIG. 5 shows a hold-down roller, for depressing the filament behind the winding wheel, in its initial (up) and final (down) position.

In FIG. 5 the hold-down roller 29 is shown in further detail from an end view in the initial or open position (up) and in the final or hold-down position (down). The hold-down roller is pivotally affixed to a follower block 40 at a spring loaded joint 41. The follower block is driven downward in a track 42 by a conventional drive device such as a pneumatic cylinder. Upon the follower block being driven downward, the axis of the hold-down roller rotates from the vertical position to the horizontal position. In operation, when the take-up head 19 moves behind the winder 28 to lay the advancing filament 4 onto the winding surface 27, the hold-down roller 29 is in the up position allowing clearance of the take-up head and filament. The hold-down roller 29 is then actuated by driving the follower block 40 with hold-down roller downward and thereby depressing the filament 4 behind the winder 28 with the hold-down roller 29. Consequently, the contact arc of the advancing filament 4 on the winding surface 27 is accentuated for the purpose of facilitating the cut-and-grip operation. When the cut-and-grip element 7 on the rotating winder 28 is actuated, a certain amount of time elapses during the fall of the element 7. This time interval corresponds to an angle of rotation of the rotating winder, termed the "fall angle", depending on the rotational speed. Thus, the angle of contact as accentuated by the hold-down roller must equal or exceed the cut-and-grip fall angle.

As discussed above, brush roller tensioning is for the purpose of maintaining the filament taut between the quench wheel and the take-up head; however, in some configurations, considering filament size, casting speed, and maximum string-up distance, the required tension to maintain tautness may exceed reasonable limits such that the filament surface is blemished or the nascent filament in the delicate quench zone is disrupted. In these unusual situations, the degree of brush roller tensioning required for filament tautness may be lessened by providing a support roller midway between the quench wheel and the brush rollers that moves with one half the speed of the take-up head. The support roller velocity vector has the same instantaneous direction but a magnitude of one half that of the take-up head. The effect of the support roller is to force the vibratory wave in the filament to a higher harmonic with leser amplitude.

While preferred embodiments of the invention have been illustrated and described, it will be recognized by those skilled in the art that the invention may be otherwise variously embodied and practiced within the scope of the following claims:

What is claimed is:

1. A method for the inline string-up of a rapidly advancing filament from a continuous forming operation onto a rotating winding wheel, comprising the steps:

(a) passing the leading portion of said filament into the nip of two counterrotating brush rollers having a peripheral velocity exceeding the velocity of said filament to the extent sufficient to produce a sliding frictional tensioning of the advancing segment of said filament;

(b) moving said brush rollers along a predetermined path passing over said winding wheel to lay a segment of said filament onto the rotating winding surface of said winding wheel; and (c) cutting said filament within its contact arc on the winding surface and securing the leading portion of the advancing segment of said filament onto the winding surface, whereupon winding of the advancing filament onto said winding wheel proceeds.

2. A method, as in claim 1, wherein step (a) further comprises selecting the tension exerted on said advancing filament by said brush rollers according to the speed difference between the surface of said brush rollers and said advancing filament and according to the degree of filament-brush contact interaction.

3. A method, as in claim 1, wherein step (b) further comprises depressing the advancing filament behind said winding wheel to accentuate the contact arc of said filament on the winding surface.

4. A method, as in claim 1, wherein said filament comprises a glassy alloy strip.

5. Apparatus for the inline string-up of a rapidly advancing filament from a continuous forming operation onto a rotating winding wheel, comprising the elements:

(a) two nipping brush rollers having selectable interference and speed of counterrotation, adapted for passing said filament into the nip thereof and tensioning the advancing segment of said filament in a sliding frictional manner;

(b) transfer means for moving said brush rollers along a predetermined path passing over said winding wheel to lay a segment of said filament onto the winding surface of said winding wheel; and (c) grip means for cutting said filament at the winding surface and securing the advancing segment of said filament onto the winding surface.

6. Apparatus, as in claim 5, further comprising hold-down means for depressing the advancing filament behind said winding wheel to accentuate the contact arc of the filament on the winding surface.

7. Apparatus as recited in claim 5, wherein said predetermined path is a cam surface and said transfer means includes a cam follower block adapted to track said cam surface.

* * * * *